US005115614A

United States Patent [19]

McGrath

[11] Patent Number: 5,115,614

[45] Date of Patent: May 26, 1992

[54] MASONRY UNIT WITH INTEGRAL FLASHING

[76] Inventor: David S. McGrath, 13855 Merrie Meadow La., South Lyon, Mich. 48178

[21] Appl. No.: 703,806

[22] Filed: May 21, 1991

[51] Int. Cl.[5] ..... E02D 19/00; E04D 17/00

[52] U.S. Cl. ..... 52/169.5; 52/303; 52/606

[58] Field of Search ..... 52/169.5, 303, 606

[56] References Cited

U.S. PATENT DOCUMENTS

| | | | |
|---|---|---|---|
| 1,394,406 | 10/1921 | Calvert | 52/303 |
| 1,430,423 | 9/1922 | Weichold | 52/303 |
| 4,910,931 | 3/1990 | Pardue | 52/303 |

*Primary Examiner*—John E. Murtagh

[57] ABSTRACT

A composite cored masonry unit with a moisture collection void that has a waterproof material that coats the surface of the portion of said unit adjacent to said void with the masonry unit having a base with a sloped top surface and flat bottom surface and with a weep hole located so as to drain moisture from the moisture collection void.

6 Claims, 3 Drawing Sheets

MASONRY UNIT WITH INTEGRAL FLASHING

This invention relates in general to a flashing system for a single-wythe, hollow masonry wall and in particular to a combination of a hollow masonry unit, cast in a shape so as to be able to collect and drain moisture from within a wall system, with a means of waterproofing the interior of the unit to prevent absorption into said unit.

Single-wythe masonry walls, walls built one block or brick thick, are commonly constructed with units made of concrete or clay with relatively large voids or cores within the unit. Since wind-driven rain often penetrates the outside face of the wall assembly and can travel vertically within the cores, a means of intercepting the moisture above obstructions to it's vertical flow, such as occur at window heads, wall bases, etc., is necessary. This has conventionally been accomplished with the use of through-wall flashings which are made of metal or membrane materials formed to certain shapes and embedded into mortar joints between masonry units.

Several disadvantages are inherent to this traditional method of flashing/wall construction. A primary disadvantage is that mortar does not bond well to conventional flashing materials, and placement of the flashing within mortar joins weakens the structural integrity of the wall assembly. Another disadvantage is that, in order to channel moisture to the exterior side of the wall, it is necessary to extend the flashing through to the interior side of the wall and turn it upward, causing an unsightly detail on the interior wall finish. Still another disadvantage is that, as an additional component to the wall system which must be installed during construction, conventional flashing procedures place greater reliance on field construction personnel, which can compromise the finished assembly and add to the cost of construction. Also, conventional details at the horizontal terminations of conventional flashing systems are relatively difficult to assemble during construction.

One of the principle objectives of this invention is to combine the flashing and masonry into a single unit which can be installed in a manner similar to that required to install typical masonry units in the system, thus simplifying the process and reducing cost. Another objective is to provide a unit that can be installed into the system without compromising the bonding capabilities or structural integrity of the wall system. Another objective is to eliminate the need to have a flashing material protrude to the interior side of the wall system.

In the accompanying drawings.

Figure 6:
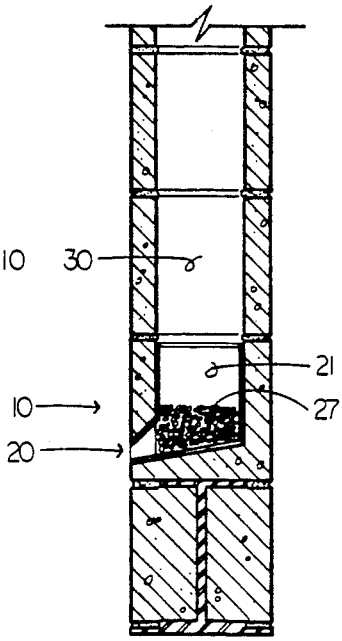
FIG. 6 illustrates the application of the unit of FIG. 1 above a structural beam in a single-wythe hollow masonry wall.

Specifically, a masonry unit 10 is manufactured in a shape whose length 11, height 12, and width 13 are dimensions compatible with the various shapes and sizes of units commonly used in the construction of masonry walls. A horizontal band of units 10 can be built into a conventional wall assembly to collect moisture running vertically down the cores 30 of hollow masonry units above said band as shown in FIG. 6. The unit 10 is comprised of an exterior face shell 14 and interior face shell 15, which are essentially parallel, connected by two side webs 16. The bottom of the unit consists of a base 17 which is flat on the bottom side 18 and pitched on the top side 19 to direct moisture toward a weep hole 20 located directly above the base 17 on the exterior face shell 14. The combination of exterior 14, interior 15 faceshells, and side webs 16 with the base 17 form a unit 10 with a void 21 in the middle of the unit which is intended to align with the cores of hollow masonry installed above, as shown in FIG. 6.

It is essential that moisture collected within the void area 21, not be allowed to be absorbed into the unit 10. This is accomplished by applying a coating or waterproof membrane 22 to the spaces within the void of the unit and also the top surface of side webs 16. It can also be accomplished by manufacturing the unit 10 with a material which is resistant to water penetration such as concrete with a waterproofing admixture or clay.

Figure 5:
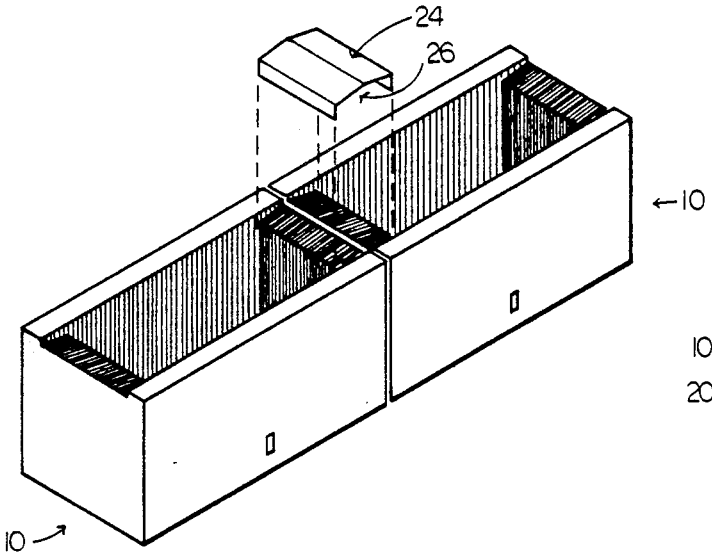
FIG. 5 is a perspective view showing a joint cover for abutting units.
Figure 7:
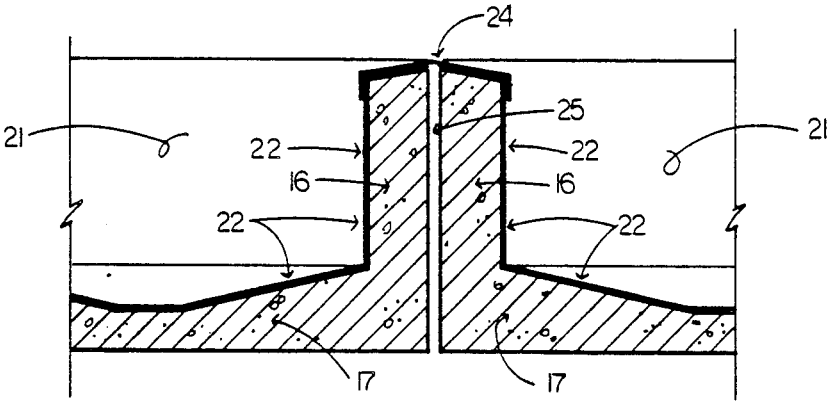
FIG. 7 is a broken sectional view of adjoining units, taken on line 7—7 of FIG. 5.

As shown in FIG. 5 and FIG. 7, as two units 10 are abutted, a splice cap 24, is utilized to prevent moisture from penetrating the space 25 between consecutive units. The splice cap 24 is comprised of a waterproof material which is flexible enough to accommodate variations in the size of the void 25, and self-adhesive on it's bottom side 26.

The top surfaces of side webs 16 are pitched toward the moisture collection void 21 and are located slightly below the top sides of the exterior 14 and interior 15 face shells to accommodate the thickness of the splice cap 24.

The weep hole 20 is an opening in the exterior face shell 14 which allows moisture to drain from the moisture collection void 21 to the exterior of the system.

During construction, granular fill material 27, such as washed gravel, is to be installed within the moisture collection void 21 to prevent mortar droppings from clogging the weep hole 20. The granular fill 27 is to be installed to a level approximately ½ of the depth of the moisture collection void 21.

Figure 1:
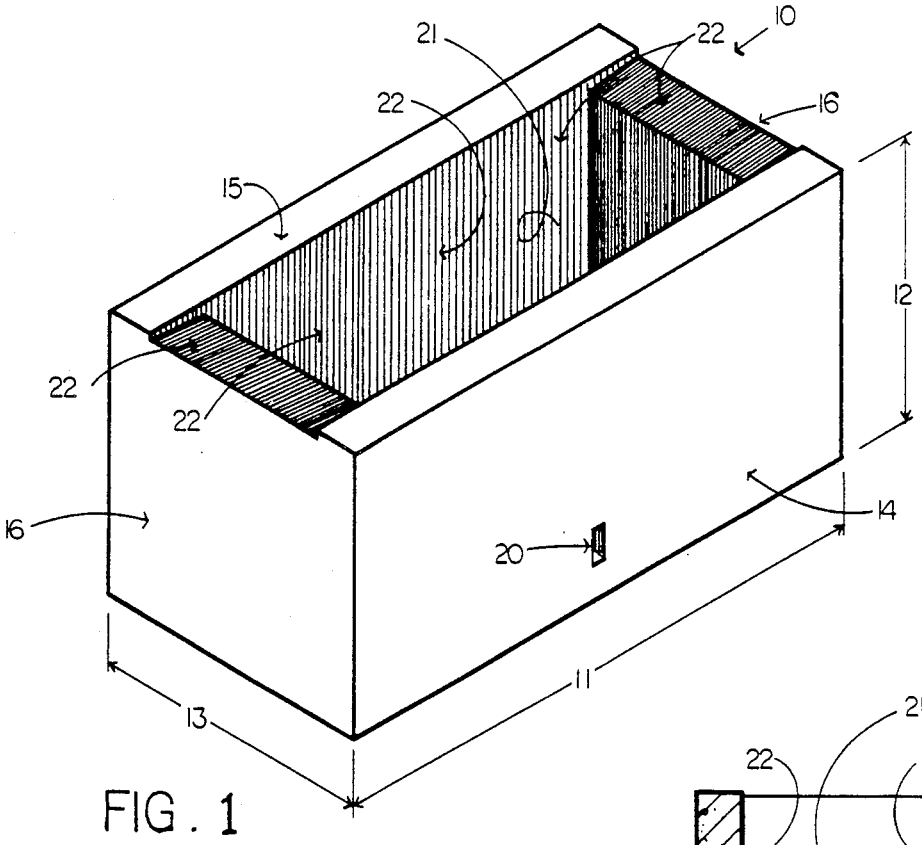
FIG. 1 is a perspective view of a unit constructed in accordance with the principals of this invention.
Figure 3:
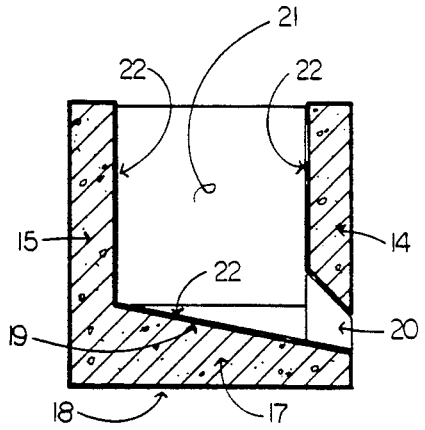
FIG. 3 is a section 3—3 of a portion of FIG. 2.
Figure 2:
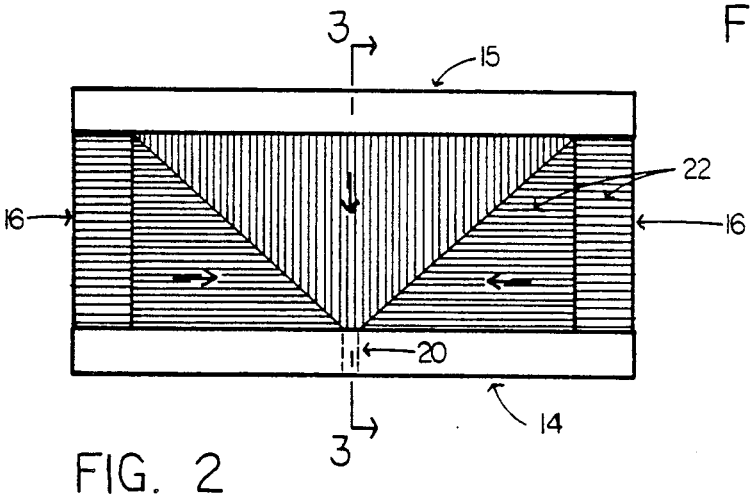
FIG. 2 is a plan view of the unit in FIG. 1.
Figure 4:
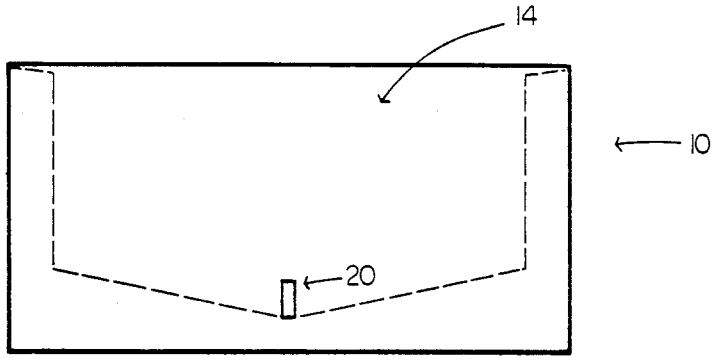
FIG. 4 is an elevation of the side of the unit which would face the exterior side of a wall system.
Figure 8:
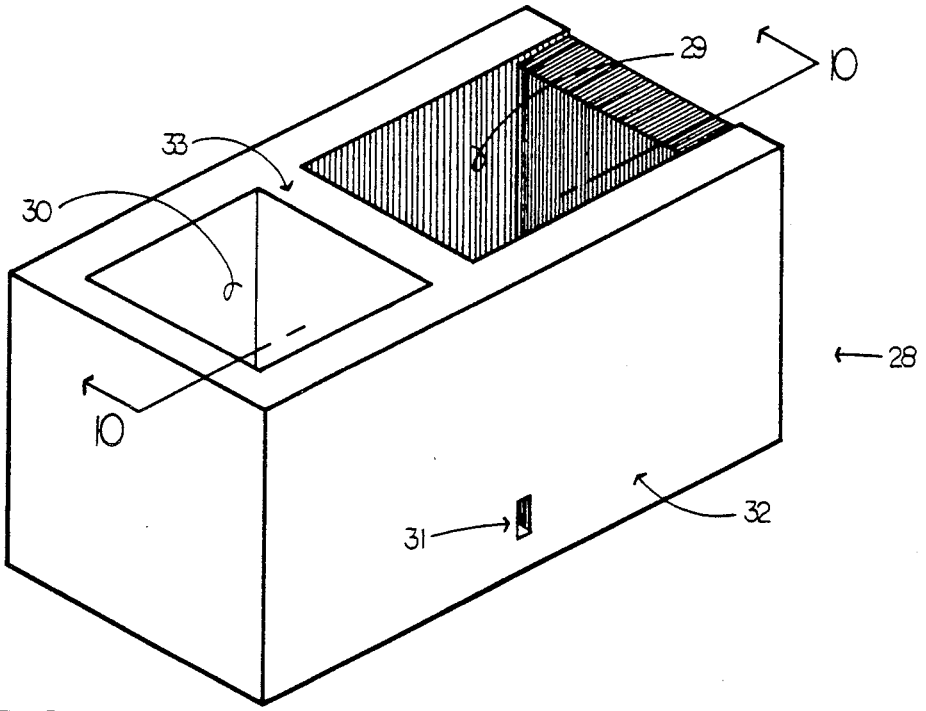
FIG. 8 is a perspective view of a unit modified for use in a wall utilizing vertical reinforcement.
Figure 9:
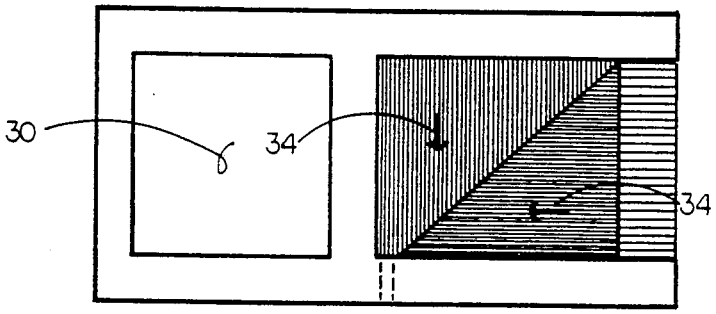
FIG. 9 is a plan view of the unit shown in FIG. 8.
Figure 10:
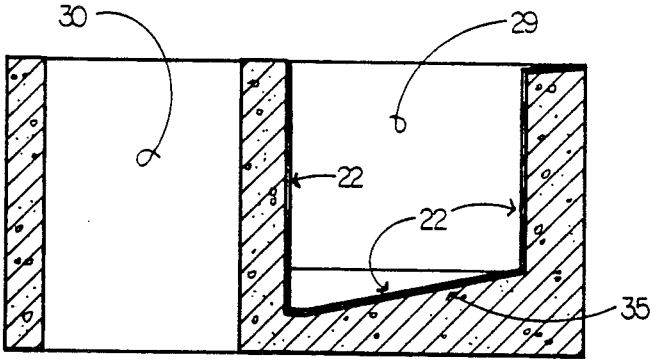
FIG. 10 is a section 10—10 of the unit shown in FIG. 8.

Because single-wythe masonry walls are often constructed with steel reinforcing and grout installed vertically in the cores of some units, the unit of FIG. 1 can be modified to accommodate the inclusion of such, as shown, in FIG. 8 and FIG. 9. These Figures illustrate a modified unit 28 with a moisture collection void 29 on one side and an open core 30 on the opposite side. It should be noted that the weep hole 31 is located in the center of the face shell web 32 by offsetting the center web 33 to the open core 30 side of the unit. The top of the base 35 of the modified unit 28 is pitched toward the weep hole 31 in two directions, as indicated by the arrows 34. The modified unit 28 can be constructed as shown in FIG. 8 and FIG. 9 or with the open core 30 and moisture collection void 29 opposite of the orientation shown.

I claim:

1. A composite masonry unit (10), comprised of a concrete block cast in a shape so as to form a moisture collection void (21) which is sized and shaped to collect and drain moisture travelling vertically within the cores of a single-wythe hollow masonry wall system, in combination with a waterproof material (22) coating the surface of the concrete material which forms the outer limits of said moisture collection void (21), said concrete block is to be comprised of an exterior face shell (14), an interior face shell (15), two side webs (16), and a base (17) which is flat on it's bottom side (18) and sloped on it's top side (19) in such a way as to direct moisture toward a weep hold (20) located directly above said base (17) in the middle of the exterior face shell (14) of said unit.

2. The composite masonry unit of claim 1 wherein waterproofing of the moisture collection void (21) is achieved by manufacturing said unit of a concrete-like material which includes an integral waterproofing admixture.

3. The composite masonry unit of claim 1 wherein waterproofing of the moisture collection void (21) is achieved by manufacturing said unit (10) of a concrete-like material with a ceramic glazing on the surface of the concrete material which forms the outer limits of said moisture collection void (21).

4. The composite masonry unit of claim 1 modified to be a component of a vertically-reinforced masonry wall by inclusion of a moisture collection void (29) on one side and an open core (30) on the opposite side sized and shaped to align with the cores of hollow concrete masonry units typically used in constructing masonry walls.

5. The composite masonry unit of claim 2 modified to be a component of a vertically-reinforced masonry wall by inclusion of a moisture collection void (29) on one side and an open core (30) on the opposite side sized and shaped to align with the cores of any hollow concrete masonry units typically used in constructing masonry walls.

6. The composite masonry unit of claim 3 modified to be a component of a vertically-reinforced masonry wall by inclusion of a moisture collection void (29) on one side and an open core (30) on the opposite side sized and shaped to align with the cores of hollow concrete masonry units typically used in constructing masonry walls.

* * * * *